US007611219B2

(12) United States Patent
Kakutani

(10) Patent No.: US 7,611,219 B2
(45) Date of Patent: Nov. 3, 2009

(54) EJECTION CONTROL OF QUALITY-ENHANCING INK

(75) Inventor: Toshiaki Kakutani, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 570 days.

(21) Appl. No.: 10/886,964

(22) Filed: Jul. 7, 2004

(65) Prior Publication Data

US 2005/0035987 A1 Feb. 17, 2005

(30) Foreign Application Priority Data

Jul. 8, 2003 (JP) ..... 2003-193262

(51) Int. Cl.
*B41J 29/38* (2006.01)

(52) U.S. Cl. ..... 347/15; 347/43; 347/100; 358/1.9; 358/1.14; 358/502; 358/3.01; 358/3.02; 358/3.03; 358/3.04; 358/3.05; 358/3.06

(58) Field of Classification Search ..... 347/15, 347/43, 100; 358/1.9, 1.14, 502, 3.01–3.06
See application file for complete search history.

(56) References Cited

U.S. PATENT DOCUMENTS 5,795,082 A * 8/1998 Shimada et al. ..... 400/120.09
6,336,705 B1 * 1/2002 Torigoe ..... 347/43
6,709,088 B2 3/2004 Hayakawa et al.
6,991,314 B2 1/2006 Hayakawa et al.
6,991,327 B2 1/2006 Goto et al.
2002/0018228 A1 * 2/2002 Torigoe ..... 358/1.14

FOREIGN PATENT DOCUMENTS

JP 2002-086760 3/2002
JP 2002-103586 4/2002
JP 2003-025563 1/2003

OTHER PUBLICATIONS

Abstract of Japanese Patent Publication No. 2002-103586, Pub. Date: Apr. 9, 2002, Patent Abstracts of Japan.
Abstract of Japanese Patent Publication No. 2002-086760, Pub. Date: Mar. 26, 2002, Patent Abstracts of Japan.
Abstract of Japanese Patent Publication No. 2003-025563, Pub. Date: Jan. 29, 2003, Patent Abstracts of Japan.

* cited by examiner

*Primary Examiner*—David K Moore
*Assistant Examiner*—Quang N Vo
(74) *Attorney, Agent, or Firm*—Martine Penilla & Gencarella, LLP

(57) ABSTRACT

A printing control method of generating dot data representing a state of dot formation at each pixel in a printed image represented by an given image data, by formation of dots in respective pixels with the at least one colored ink and the quality-enhancing ink available in the print unit. This process includes a processing mode configured to make a quality-enhancing ink dot-recording rate for pixels belonging to a peripheral area lower than the quality-enhancing ink dot-recording rate for pixels belonging to a center area.

11 Claims, 13 Drawing Sheets

FIRST EMBODIMENT

FIRST EMBODIMENT

SECOND EMBODIMENT

THIRD EMBODIMENT

FOURTH EMBODIMENT
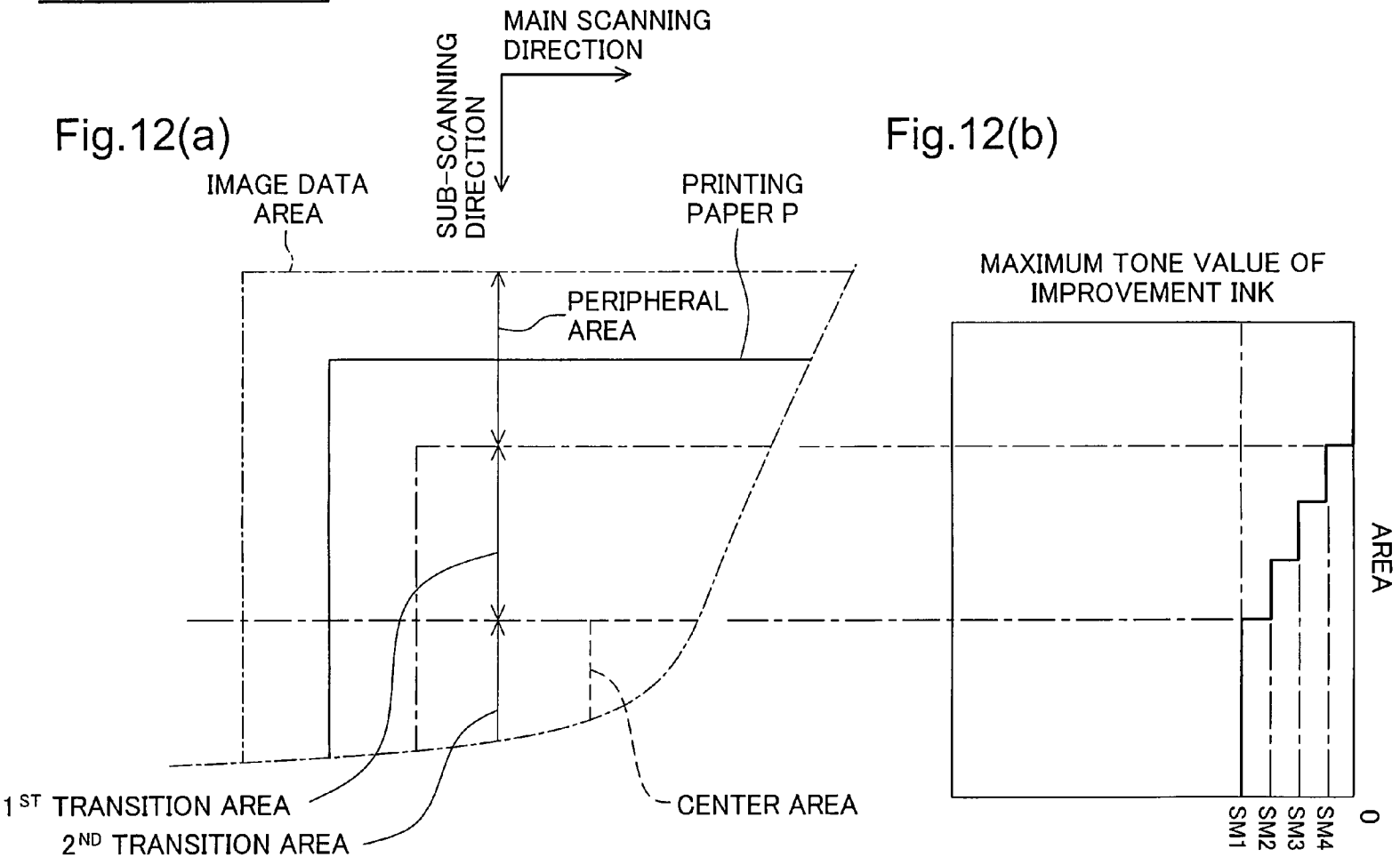

EJECTION CONTROL OF QUALITY-ENHANCING INK

BACKGROUND OF THE INVENTION

1. Field of the Invention

The present invention relates to a printing technique that ejects ink droplets of multiple types of inks on a printing medium to print an image.

2. Description of the Related Art

Printers that eject inks from nozzles on a print head have widely been used as an output unit of the computer. There is a known printer that is capable of printing an image to respective ends of printing paper (see Japanese Patent Laid-Open Gazette No. 2002-103586). One proposed method to attain such margin-free printing uses ink absorption materials set in grooves of a platen to absorb ink ejected outside the printing paper. Quality-enhancing ink is used to enhance the quality of printed materials, for example, enhancement of color development, water resistance, and light resistance and reduction of a variation in gloss.

The Quality-enhancing ink may, however, be dried up on the surface of the ink absorption materials and interfere with smooth absorption of colored inks into the ink absorption materials. The Quality-enhancing ink is used not for coloring but for improvement of the quality of the printed materials. Partial absence of the Quality-enhancing ink thus does not significantly deteriorate the quality, additionally the deterioration of the quality is rather inconspicuous at the ends of the printed materials.

SUMMARY OF THE INVENTION

The object of the invention is to provide a printing technique that prints an image to respective ends of a printing medium, while reducing ejection of ink droplets of quality-enhancing ink outside the printing medium.

In order to attain the above objects of the present invention, there is provided a printing control method of generating print data to be supplied to a print unit to print. The print unit forms dots on a print medium by ejecting ink droplets of at least one type of colored ink containing a color material and a quality-enhancing ink for enhancing quality of a printed material. The printing control method comprises the dot data-generating step of generating dot data representing a state of dot formation at each pixel in a printed image to reproduce an image represented by an given image data, by formation of dots in respective pixels with the at least one colored ink and the quality-enhancing ink available in the print unit. The step includes a processing mode configured to make a quality-enhancing ink dot-recording rate for pixels belonging to a peripheral area lower than the quality-enhancing ink dot-recording rate for pixels belonging to a center area with regard to at least one identical pixel value of the image data. The quality-enhancing ink dot-recording rate is a dot-recording rate of the quality-enhancing ink. The peripheral area is set at end portions of the printing medium. The center area is set in a central portion of the printing medium.

The printing method of the invention is capable of making the quality-enhancing ink dot-recording rate for the pixels belonging to the peripheral area lower than the quality-enhancing ink dot recording rate for the pixels belonging to the center area. This arrangement ensures printing to the respective ends of the printing medium, while reducing ejection of ink droplets of the quality-enhancing ink outside the printing medium.

In the specification hereof, the terminology "printed material" represents a print obtained by ejection of ink droplets of the colored ink and the quality-enhancing ink on the printing medium. The terminology "quality-enhancing ink" represents ink used for enhancing the quality of printed materials, for example, enhancement of color development, water resistance, and light resistance and reduction of a variation in gloss.

The present invention can be realized in various forms such as a method and apparatus for printing, a method and apparatus for printing control, and a computer-program product implementing the above scheme.

These and other objects, features, aspects, and advantages of the present invention will become more apparent from the following detailed description of the preferred embodiments with the accompanying drawings.

BRIEF DESCRIPTION OF THE DRAWINGS

FIGS. 12(*a*), 12(*b*) are plan views showing division of the area of image data relative to the printing paper P in the fourth embodiment of the invention.

DESCRIPTION OF THE PREFERRED EMBODIMENTS

Some modes of carrying out the invention are discussed below in the following sequence as preferred embodiments with reference to the accompanied drawings:

A. Configuration of System

B. Print Data Generation Process of First Embodiment

C. Print Data Generation Process of Second Embodiment

D. Print Data Generation Process of Third Embodiment

E. Print Data Generation Process of Fourth Embodiment

F. Modifications

A. Configuration of System

Figure 1:
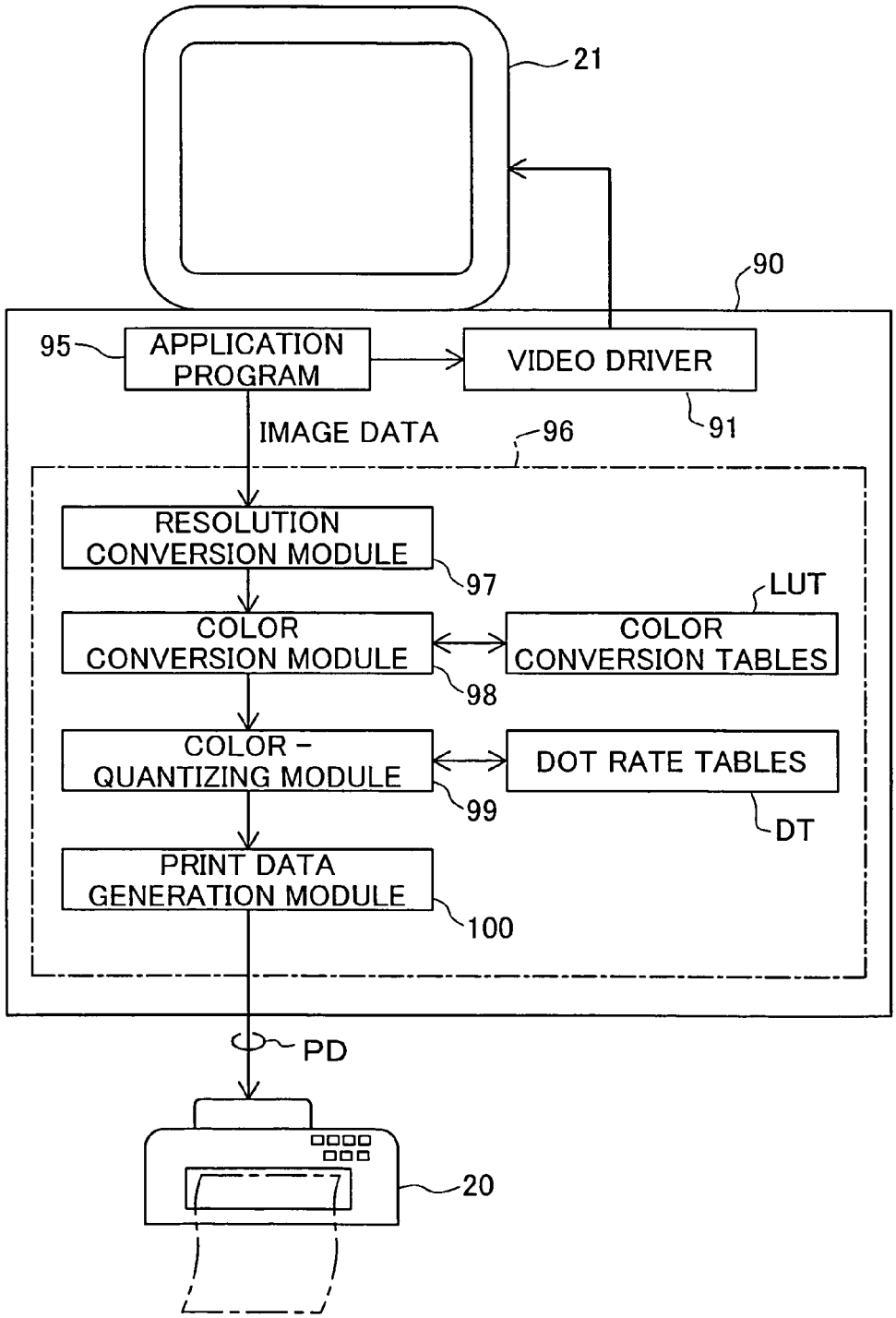
FIG. 1 is a block diagram schematically illustrating the configuration of a printing system in one embodiment of the invention.

FIG. 1 is a block diagram schematically illustrating the configuration of a printing system in one embodiment of the invention. This printing system includes a computer 90 functioning as a printing control apparatus and a color printer 20 functioning as a print unit. The combination of the color printer 20 with the computer 90 is regarded as a "printing apparatus" in the broad sense.

Application program 95 operates on computer 90 under a specific operating system. A video driver 91 and a printer driver 96 are incorporated in the operating system. The application program 95 outputs image data, which goes through a series of image processing in the printer driver 96 and is given as print data PD to the color printer 20. The application program 95 also outputs image data to display a processed image on a CRT 21 via the video driver 91.

The printer driver 96 includes a resolution conversion module 97, a color conversion module 98, a color-quantizing module 99, a print data generation module 100, multiple color conversion tables LUT, and a dot rate table DT. The functions of these constituents will be discussed later.

The printer driver 96 is equivalent to a program functioning to generate the print data PD. The program of attaining the functions of the printer driver 96 is supplied in the form recorded in a computer readable recording medium. Typical examples of such computer readable recording medium include flexible disks, CD-ROMs, magneto-optic disks, IC cards, ROM cartridges, punched cards, prints with barcodes or other codes printed thereon, internal storage devices (memories like RAM and ROM) and external storage devices of the computer, and a diversity of other computer readable media.

Figure 2:
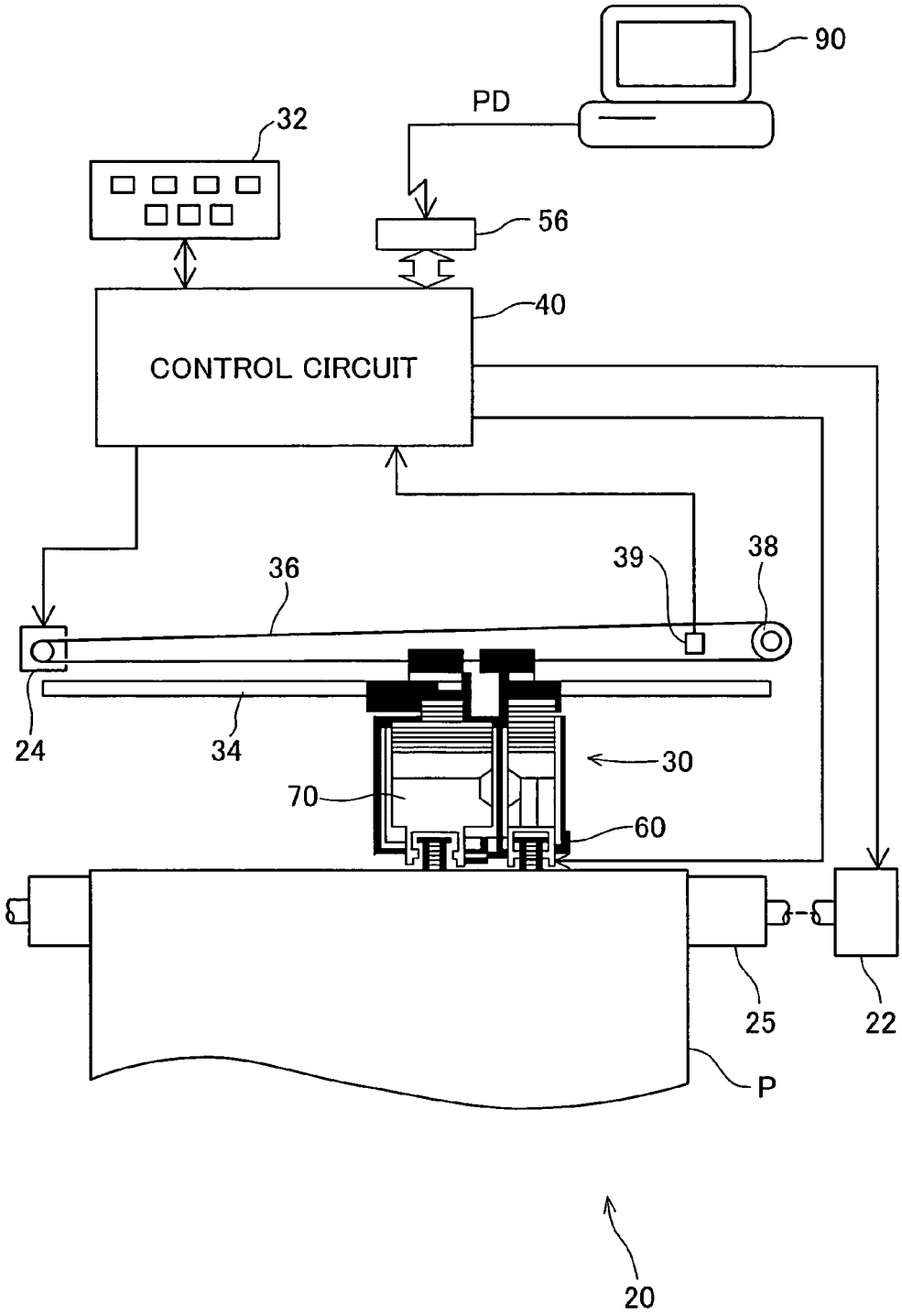
FIG. 2 schematically illustrates the structure of a color printer included in the printing system.

FIG. 2 schematically illustrates the structure of the color printer 20. The color printer 20 has a sub-scan drive unit that activates a paper feed motor 22 to feed a sheet of printing paper P in a sub-scanning direction, a main scan drive unit that activates a carriage motor 24 to move a carriage 30 back and forth in an axial direction of a paper feed roller 25 (in a main scanning direction), a head drive mechanism that drives a print head unit 60 (also called 'print head assembly') mounted on the carriage 30 to control ink ejection and dot formation, and a control circuit 40 that transmits signals to and from the paper feed motor 22, the carriage motor 24, the print head unit 60, and an operation panel 32. The control circuit 40 is connected to the computer 90 via a connector 56.

The sub-scan drive unit for feeding the printing paper P has a non-illustrated gear train to transmit rotation of the paper feed motor 22 to the paper feed roller 25. The main scan drive unit for reciprocating the carriage 30 has a sliding shaft 34 that is arranged in parallel with the axis of the paper feed roller 25 to hold the carriage 30 in a slidable manner, a pulley 38 that supports an endless drive belt 36 spanned between the carriage motor 24 and the pulley 38, and a position sensor 39 that detects the position of the origin of the carriage 30.

Figure 3:
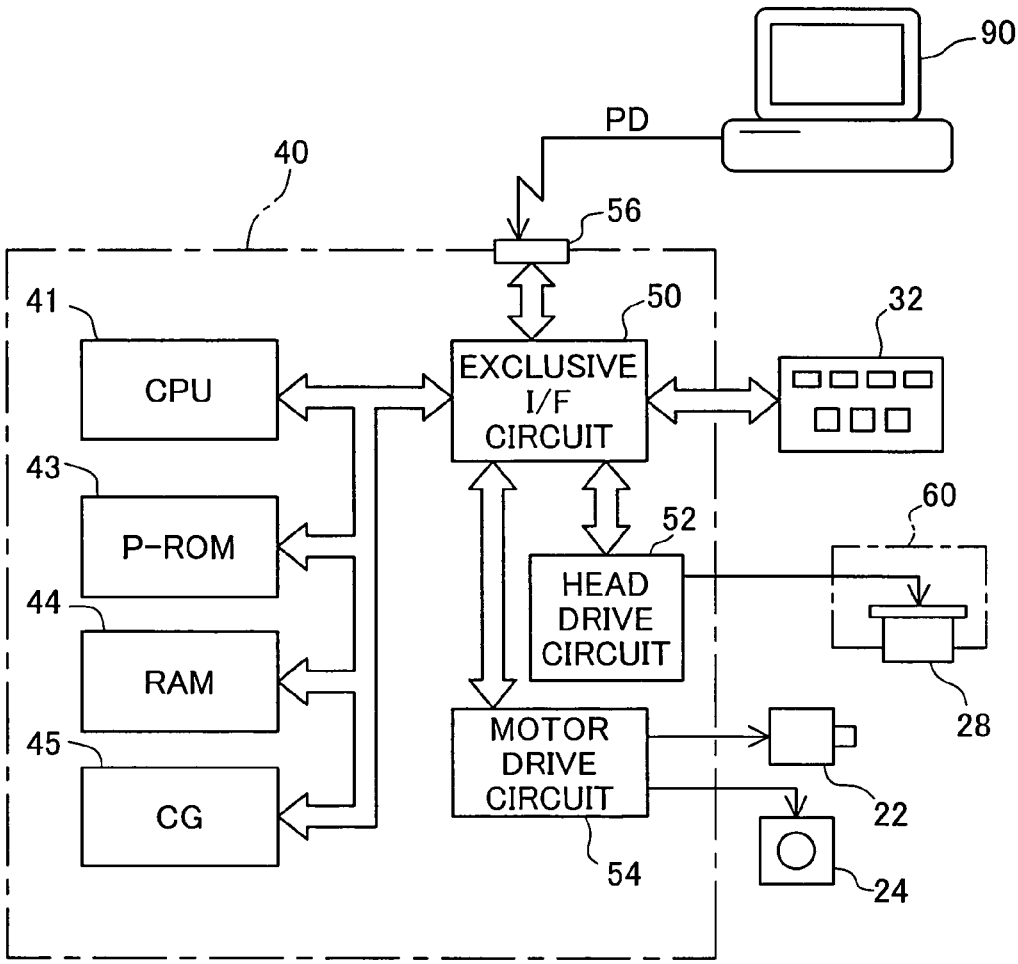
FIG. 3 is a block diagram showing the internal structure of the color printer including a control circuit.

FIG. 3 is a block diagram showing the internal structure of the color printer 20 including the control circuit 40. The control circuit 40 is constructed as an arithmetic logic circuit, which includes a CPU 41, a programmable ROM (P-ROM) 43, a RAM 44, and a character generator (CG) 45 storing dot matrixes of characters. The control circuit 40 also has an exclusive I/F circuit 50 functioning as an interface to external motors and other elements, a head drive circuit 52 that is connected with the exclusive I/F circuit 50 and drives the print head unit 60 for ink ejection, and a motor drive circuit 54 that is connected with the exclusive I/F circuit 50 and drives the paper feed motor 22 and the carriage motor 24. The exclusive I/F circuit 50 has a built-in parallel interface circuit and receives the print data PD from the computer 90 via the connector 56. The color printer 20 carries out printing according to the received print data PD. The RAM 44 works as a buffer memory to temporarily store raster data.

The print head unit 60 has a print head 28 and supports ink cartridges detachably attached thereto. The print head unit 60 is attached and detached as an integral unit to and from the color printer 20. Namely replacement of the print head 28 requires replacement of the whole print head unit 60.

Figure 4A:
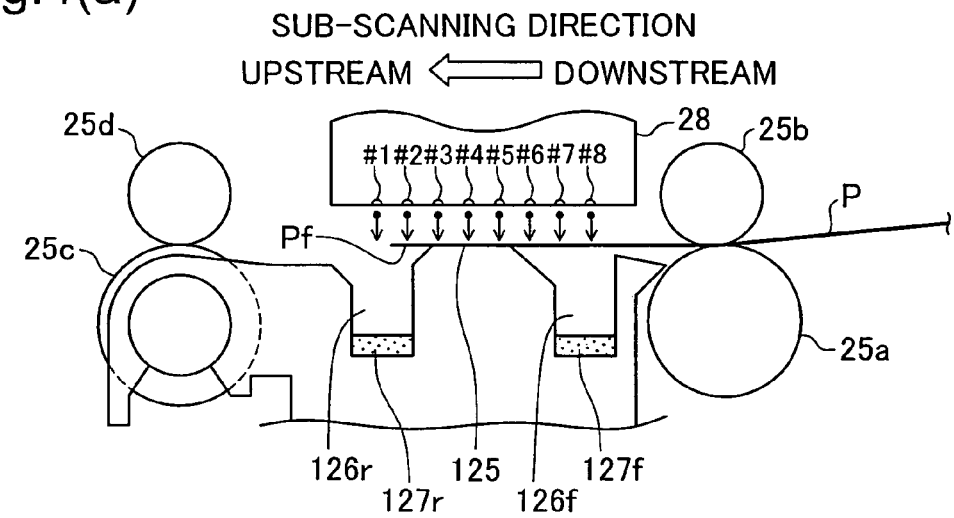
FIGS. 4(*a*), 4(*b*), 4(*c*) show printing processes on respective ends of printing paper P.
Figure 4B:
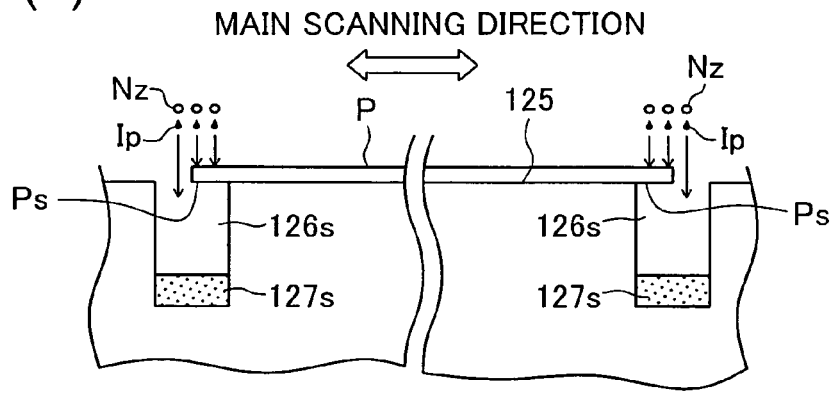
Figure 4C:
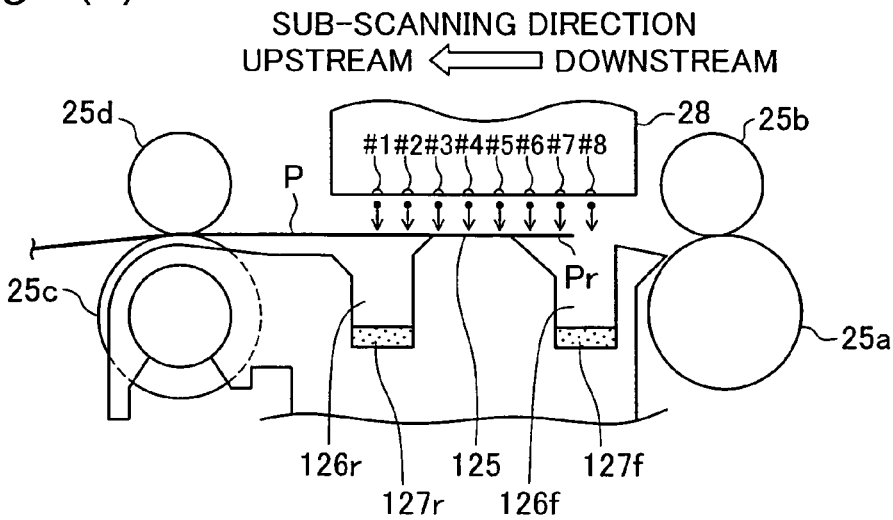

FIGS. 4(*a*), 4(*b*), 4(*c*) show printing processes on respective ends of the printing paper P. Two nozzles #1 and #2 on the print head 28 are located above the opening of a downstream groove 126*r*, and two other nozzles #7 and #8 are located above the opening of an upstream groove 126*f*. Other nozzles #3, #4, #5, and #6 are located above a platen frame 125. As shown in FIG. 4(*b*), each side end Ps of the printing paper P is positioned above the opening of a side groove 126*s*. Ink absorption materials 127*r*, 127*f*, and 127*s* for absorbing ink are respectively set in the downstream groove 126*r*, the upstream groove 126*f*, and the side grooves 126*s*.

The two pairs of nozzles #1 and #2, #7 and #8 are respectively located above the opening of the downstream groove 126*r* and above the opening of the upstream groove 126*f*. This structure protects the platen frame 125 and a roller 25*d* from stains of ink that is ejected from the nozzles #1, #2, #7, and #8 before the printing paper P fed by the sub-scan feed reaches the respective nozzles #1, #2, #7, and #8 or after the printing paper P passes through the respective nozzles #1, #2, #7, and #8. The sub-scan feed of the printing paper P is implemented by at least either a pair of upstream paper feed rollers 25*a* and 25*b* or a pair of downstream paper feed rollers 25*c* and 25*d*. The upstream paper feed rollers 25*a* and 25*b* and the downstream paper feed rollers 25*c* and 25*d* are equivalent to the paper feed roller 25 mentioned previously.

FIG. 4(*a*) shows a printing process on a front end Pf of the printing paper P. The two nozzles #1 and #2 start ink ejection a little before the front end Pf of the printing paper P reaches the effective recording positions of these nozzles #1 and #2. Even in the presence of some paper feed error, this arrangement does not make any undesirable margin but ensures printing to the front end Pf of the printing paper P, while protecting the platen frame 125 and the roller 25*d* from stains of ink.

FIG. 4(*b*) shows a printing process on side ends Ps of the printing paper P. Each side end Ps of the printing paper P is located above the opening of the side groove 126*s*. This arrangement does not make any undesirable margin but ensures printing to the side ends Ps of the printing paper P.

FIG. 4(*c*) shows a printing process on a rear end Pr of the printing paper P. The two nozzles #7 and #8 stop ink ejection after the rear end Pr of the printing paper P passes through the effective recording positions of these nozzles #7 and #8. Even in the presence of some paper feed error, this arrangement does not make any undesirable margin but ensures printing to the rear end Pr of the printing paper P, while protecting the platen frame 125 and the roller 25*d* from stains of ink.

Figure 5:
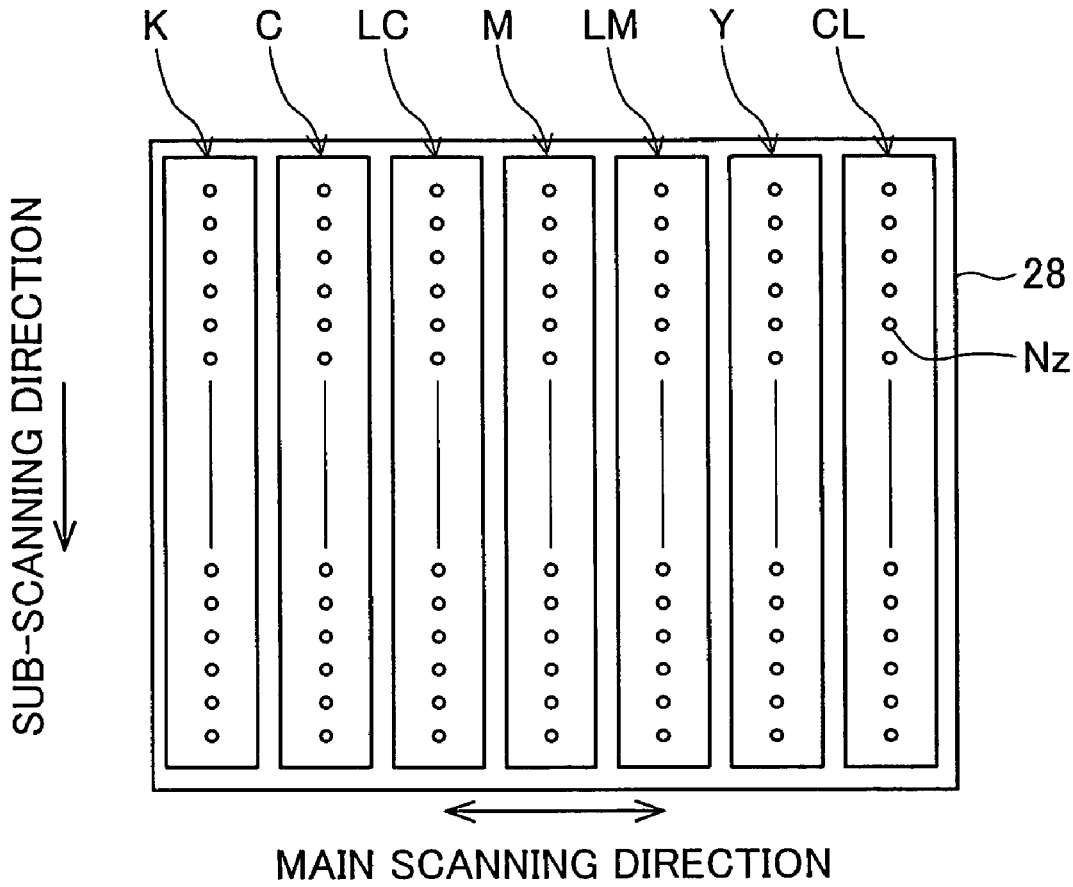
FIG. 5 shows an arrangement of nozzles Nz on the bottom face of a print head.

FIG. 5 shows an arrangement of nozzles Nz on the bottom face of the print head 28. Nozzle arrays for black ink K, cyan ink C, light cyan ink LC, magenta ink M, light magenta ink LM, yellow ink Y, and quality-enhancing ink CL are formed on the bottom face of the print head 28.

The available inks other than the quality-enhancing ink CL are not restricted to these six inks K, C, LC, M, LM, and Y but may be selected arbitrarily according to the desired picture quality of printed material images. For example, the four inks K, C, M, and Y may be used, or only the black ink K may be used. Dark yellow ink having the lower lightness than the yellow ink Y, gray ink having the higher lightness than the black ink K, blue ink, red ink, and green ink may be used in some combinations. In the specification hereof, ink containing any of such color material is called 'colored ink'.

The quality-enhancing ink CL may be transparent and colorless ink having similar gloss to the other inks and enhancing the color development of the other inks. The quality-enhancing ink CL may be ink disclosed in Japanese Patent Laid-Open Gazette No. 8-60059. The quality-enhancing ink CL functions to reduce the variation in gloss and enhance the color development, thus improving the picture quality of the printed material. The quality-enhancing ink CL may otherwise be ink for enhancing the water resistance or the light resistance to improve the water resistance or the light resistance of printed material.

In the color printer 20 having the hardware structure discussed above, while the printing paper P is fed by the paper feed motor 22, the carriage 30 is moved back and forth by means of the carriage motor 24 and simultaneously piezoelectric elements on the print head 28 are actuated to eject ink droplets of the respective color inks and form ink dots of variable sizes (large, medium, small). This gives a multicolor, multi-tone image on the printing paper P.

B. Print Data Generation Process of First Embodiment

Figure 6:
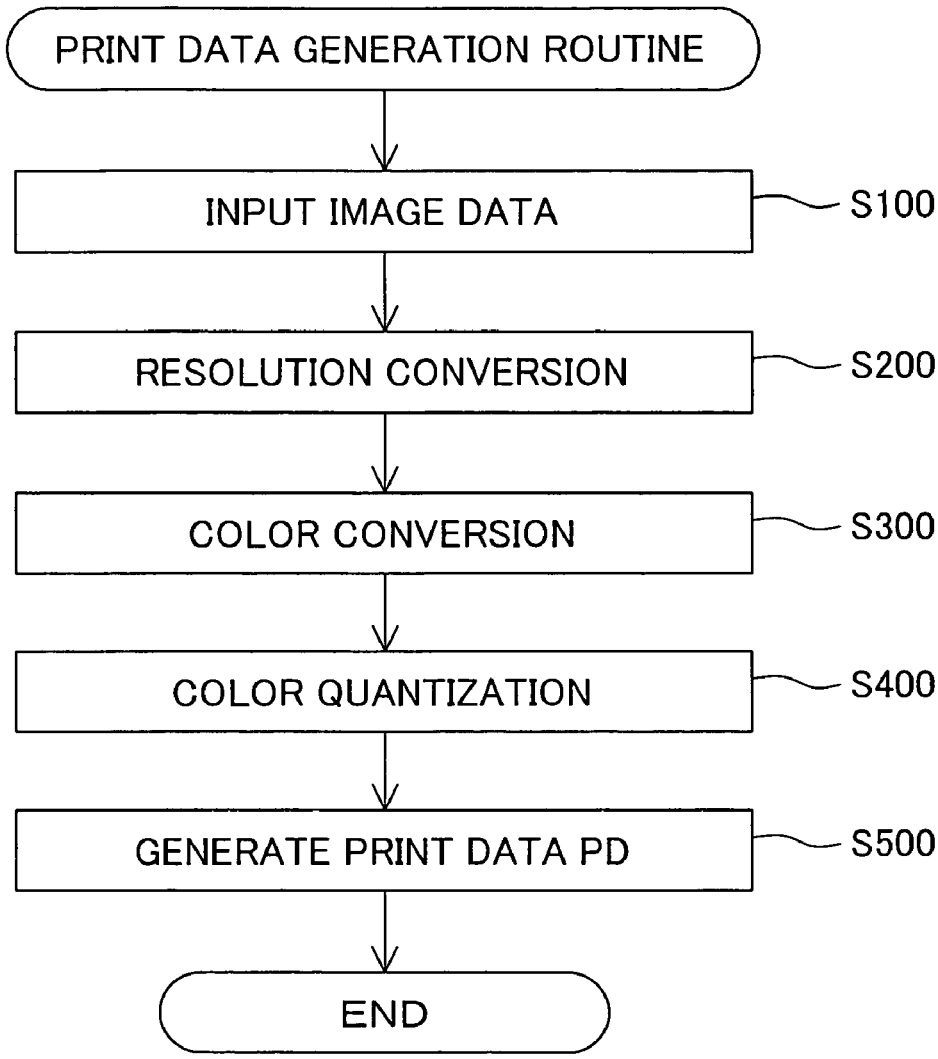
FIG. 6 is a flowchart showing a print data generation routine executed in the first embodiment.

FIG. 6 is a flowchart showing a print data generation routine executed in the first embodiment. The print data generation routine is executed by the computer 90 to generate print data PD, which is given to the color printer 20. A margin-free print mode is set for printing to the respective ends of the printing paper P.

At step S100, the printer driver 96 (see FIG. 1) inputs image data from the application program 95. Input of the image data is triggered by a printing instruction from the application program 95. In this embodiment, the input image data is RGB image data.

At step S200, the resolution conversion module 97 converts the resolution (the number of pixels per unit length) of the input RGB image data into a predetermined resolution. The predetermined resolution is set to assure a printable area to the respective ends of the printing paper P.

The resolution conversion module 97 divides the area of the image data into a "center area" and a "peripheral area". The center area is set such that restriction of ink ejection to the center area prevents any ink droplet from being flown outside the printing paper P, regardless of any potential error in sub-scan feed of the printing paper P or any potential flight error of ink droplets. The peripheral area is non-center area in the area of the image data.

Figure 7:
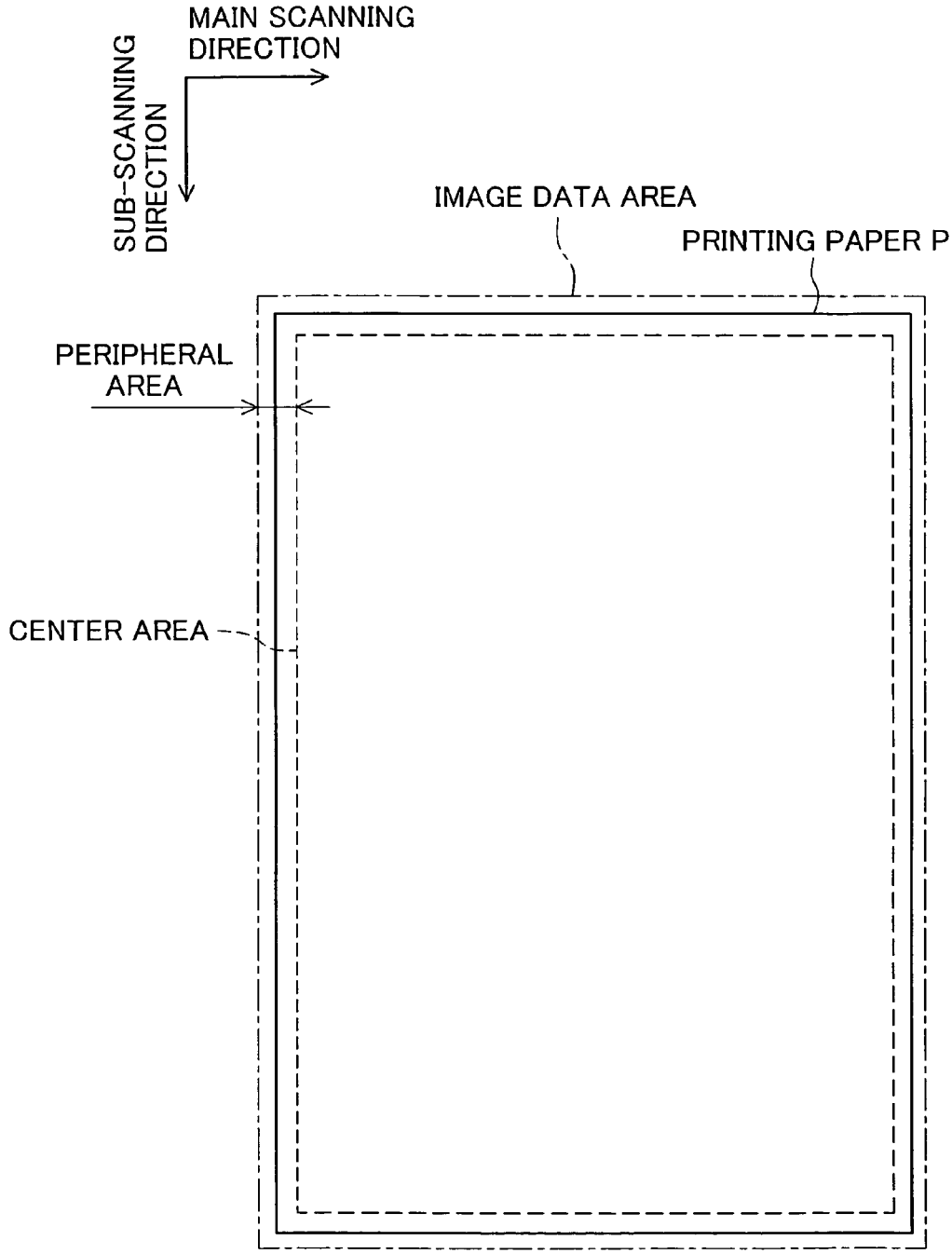
FIG. 7 is a plan view showing division of the area of resolution-converted image data relative to the printing paper P.

FIG. 7 is a plan view showing division of the area of the resolution-converted image data relative to the printing paper P. As clearly shown in FIG. 7, the whole area of the image data is set wider than the whole area of the printing paper P. Such setting enables ink droplets of each colored ink to be flown to the respective ends of the printing paper P, regardless of any potential error in sub-scan feed of the printing paper P or any potential flight error of ink droplets.

The area of the image data is, however, limited to a specific range that effectively prevents ink droplets of each colored ink miss-hitting the printing paper P from being flown outside the upstream groove 126*f*, the downstream groove 126*r*, and the side grooves 126*s* (see FIG. 4). Such restriction protects the platen frame 125 of the color printer 20 from stains of ink droplets of each colored ink.

The image data regarding the quality-enhancing ink CL is subjected to a preset series of processing. This prevents ink droplets of the quality-enhancing ink CL from being ejected in the peripheral area but to restrict ejection of ink droplets to the center area. The ink droplets of the quality-enhancing ink CL flown outside the printing paper P are dried up on the surface of the ink absorption materials 127*r*, 127*f*, and 127*s* and may interfere with smooth absorption of the color inks into the ink absorption materials 127*r*, 127*f*, and 127*s*.

At step S300, the color conversion module 98 refers to the color conversion tables LUT and converts the RGB image data of the respective pixels into multi-tone data of the respective colored inks and the quality-enhancing ink available in the color printer 20. The color conversion tables LUT referred to here include a color conversion table LUTmid for the center area applied to the pixels belonging to the center area and a color conversion table LUTend for the peripheral area applied to the pixels belonging to the peripheral area.

Figure 8:
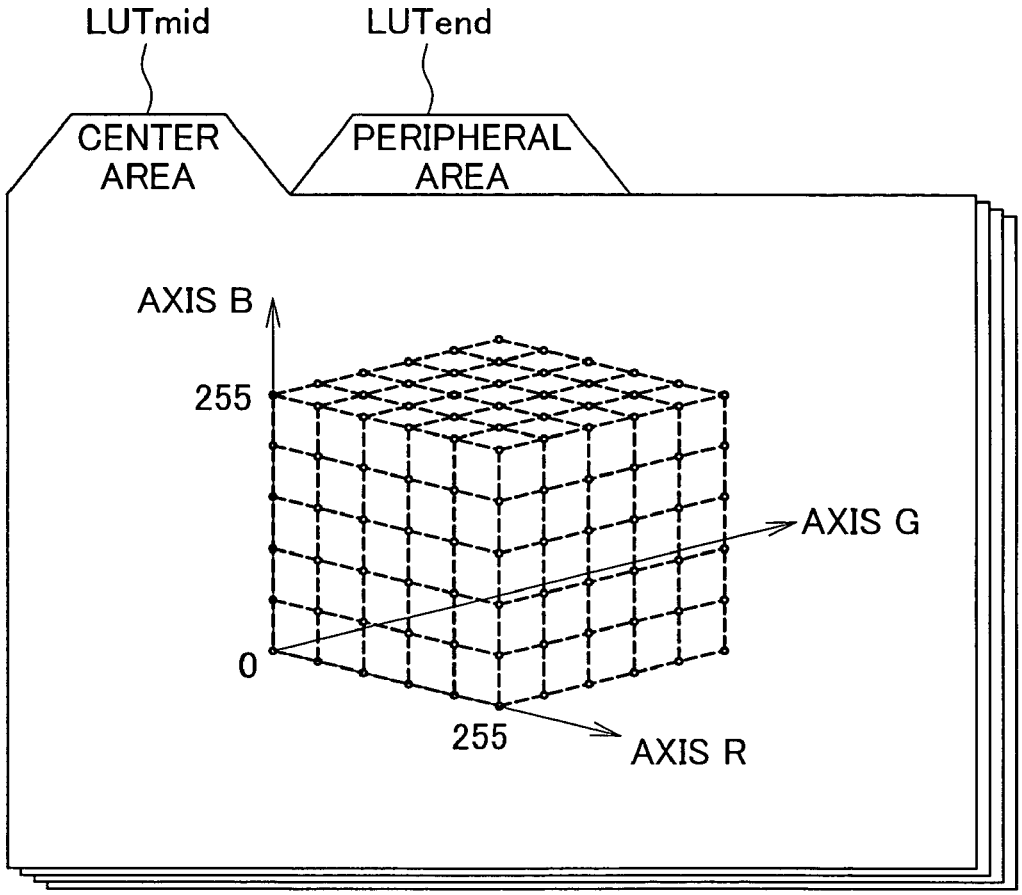
FIG. 8 shows color conversion tables applied to determine dot level data of three variable-size dots, large-size, medium-size, and small-size dots.

FIG. 8 shows the color conversion table LUTmid for the center area and the color conversion table LUTend for the peripheral area. Each of the color conversion tables LUTmid and LUTend stores settings of ink ejection volumes corresponding to R, G, and B tone values. The color conversion module 98 refers to these color conversion tables LUTmid and LUTend and determines the ejection volumes of the colored ink and the quality-enhancing ink corresponding to the tone values R, G, and B. The ink ejection volume may be expressed by a dot-recording rate, where 100% represents the state of filling all the pixels with ink droplets of any of these inks. Both the RGB image data and the ink ejection volumes are divided into 256 tones and may thus take tone values in the range of 0 to 255.

Figure 9A:
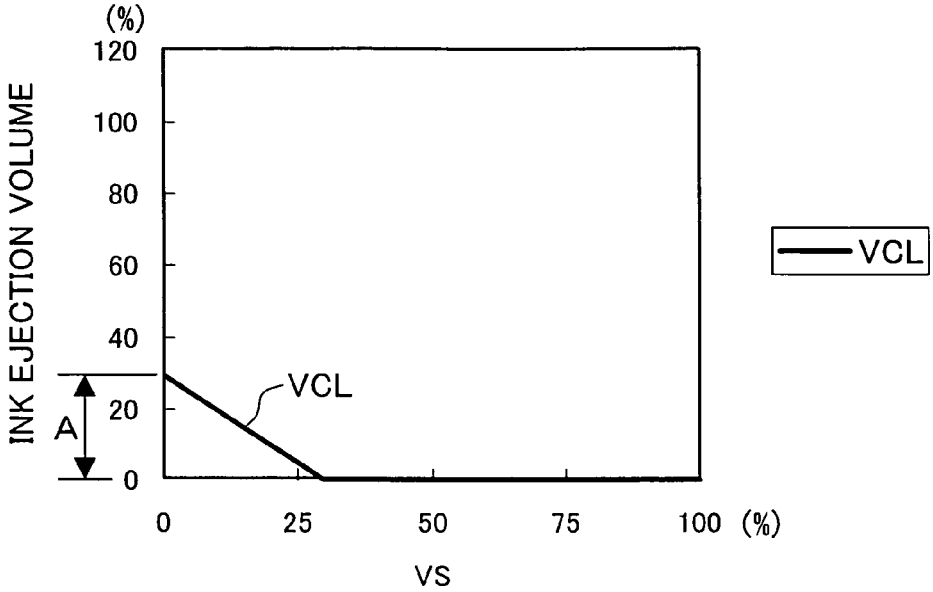
FIGS. 9(*a*), 9(*b*) are graphs showing a variation in ejection volume of a quality-enhancing ink against the ejection volume of a colored ink in a center area.
Figure 9B:
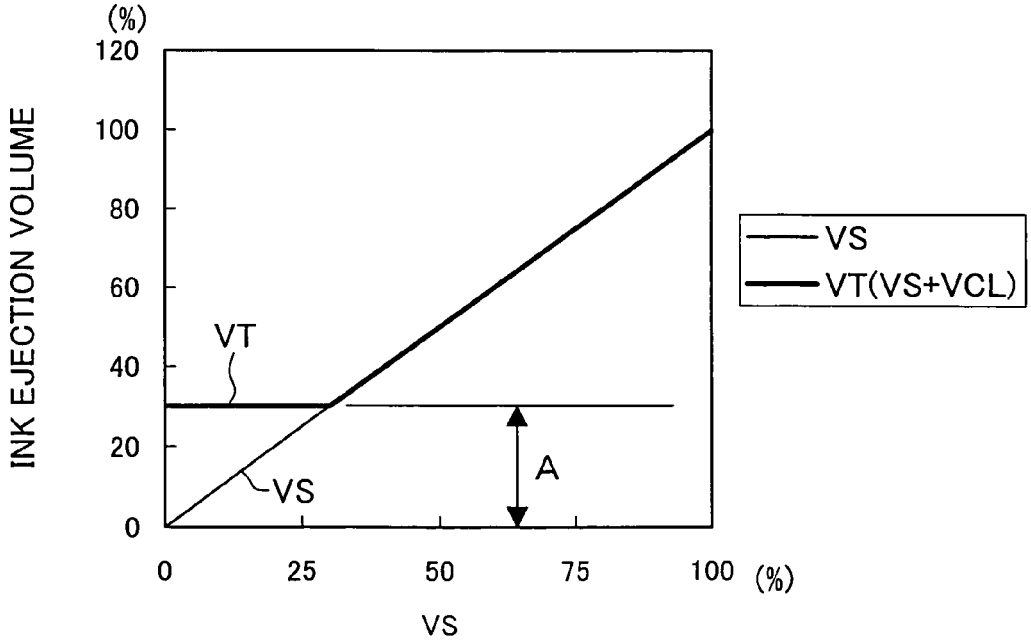

FIGS. 9(*a*), 9(*b*) are graphs showing a variation in ejection volume of the quality-enhancing ink against the ejection volume of the colored ink in the center area. FIG. 9(*a*) shows a variation in ejection volume VCL of the quality-enhancing ink against the ejection volume VS of the colored ink in the center area. FIG. 9(*b*) shows a variation in total ejection volume VT (=VS+VCL) of the colored ink and the quality-enhancing ink against the ejection volume VS of the colored ink in the center area.

The color conversion table LUTmid for the center area may have the settings of the ejection volume of the quality-enhancing ink shown in FIG. 9. These settings allow a greater volume of the quality-enhancing ink to be ejected in the area having a less ejection volume of the colored ink. This arrangement desirably prevents a variation of the gloss in printing on a relatively glossy printing medium, on the condition that the quality-enhancing ink has the similar gloss to that of the colored ink. This is because the area of the greater ink ejection volume tends to have the higher gloss in printing on the relatively glossy printing medium.

In the color conversion table LUTend for the peripheral area, the ejection volume of the quality-enhancing ink is set equal to 0, irrespective of the ejection volume of the colored ink. Ejection of the quality-enhancing ink is prohibited in the peripheral area, in order to prevent ink droplets of the quality-enhancing ink from being flown outside the printing paper P. On some occasions, uniform ejection of the quality-enhancing ink may be desired, irrespective of the ejection volume of the colored ink. In such cases, the ejection volume of the quality-enhancing ink is also set equal to 0 in the color conversion table LUTend for the peripheral area.

At step S400, the color-quantizing module 99 carries out color-quantizing to reduce 256 tones of the multi-tone data to, for example, 2 tones expressible in each pixel by the color printer 20. The 2 tones are expressed as 'dot-on' and 'dot-off' in this embodiment.

At step S500, the print data generation module 100 rearranges the dot data representing the dot on-off state of the respective pixels in an order of transfer to the color printer 20 and outputs the rearranged dot data as final print data PD. The print data PD includes raster data representing dot-recording conditions in each main scan and data representing amounts of sub-scan feed.

The procedure of this embodiment generates the dot data to prohibit ejection of the quality-enhancing ink CL with regard to the pixels belonging to the peripheral area. The dot data thus generated effectively prevents ink droplets of the quality-enhancing ink CL from being flown outside the printing paper P. This arrangement desirably prevents the ink droplets of the quality-enhancing ink CL from being dried up on the surface of the ink absorption materials 127*r*, 127*f*, and 127*s* and thereby assures smooth absorption of the colored inks into the ink absorption materials 127*r*, 127*f*, and 127*s*.

As described previously, the center area is set such that restriction of ink ejection to the center area prevents any ink droplet from being flown outside the printing paper P, regardless of any potential error in sub-scan feed of the printing paper P or any potential flight error of ink droplets. Alternatively the center area may be set such that restriction of ink ejection to the center area prevents any ink droplet from being flown outside the printing paper P, in the absence of any potential error in sub-scan feed of the printing paper P or any potential flight error of ink droplets. The center area may otherwise be set to have a wider area.

C. Print Data Generation Process of Second Embodiment

Figure 10A:
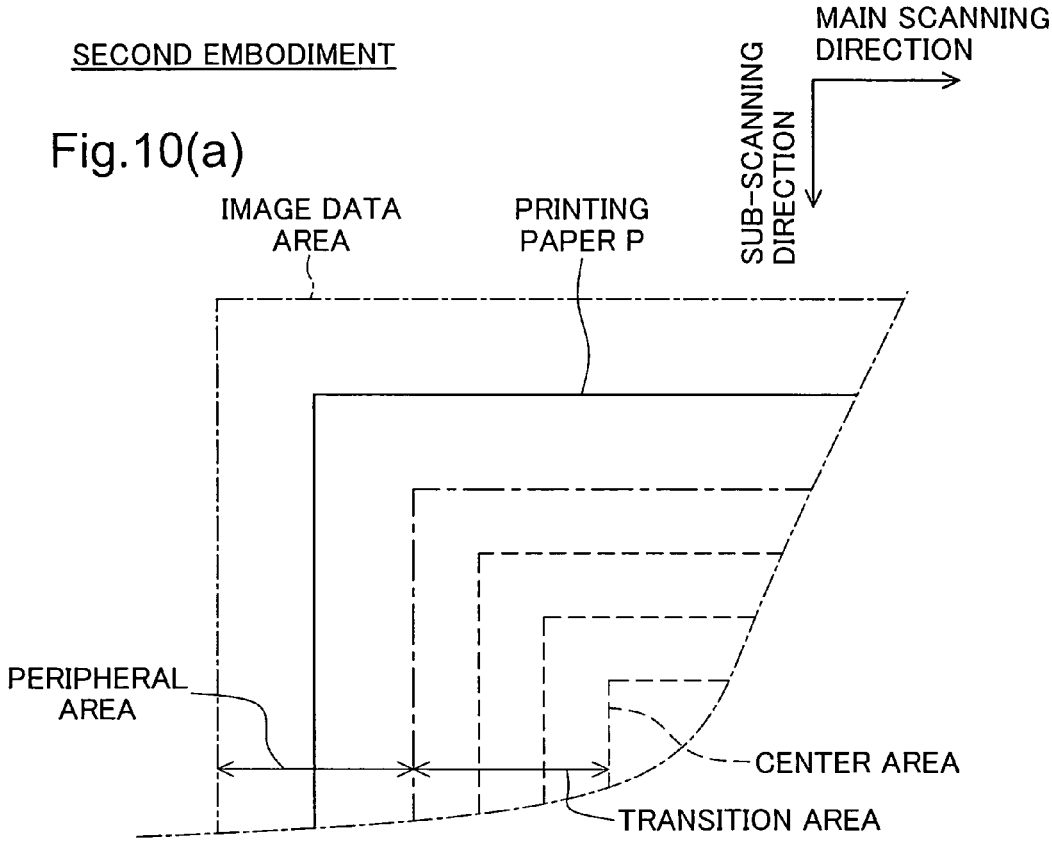
FIGS. 10(*a*), 10(*b*) are plan views showing division of the area of image data relative to the printing paper P in the second embodiment of the invention.
Figure 10B:
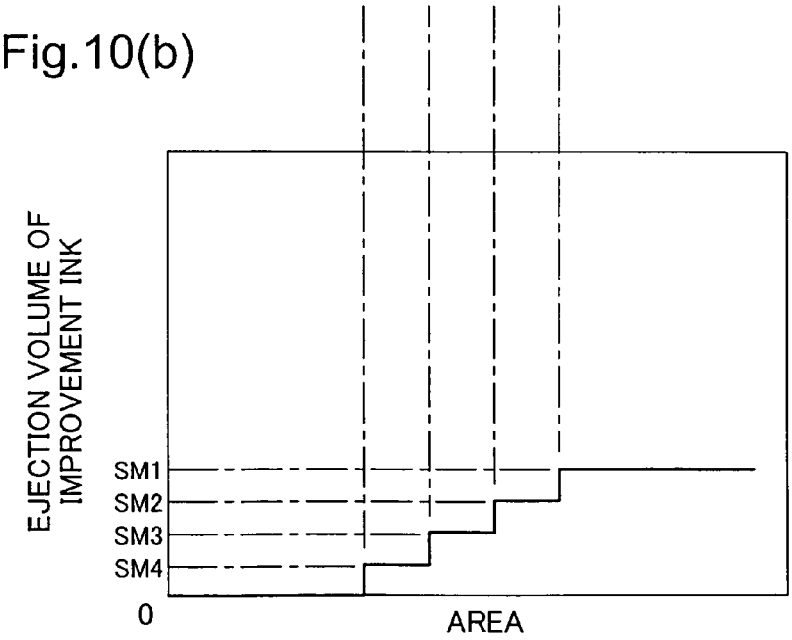

FIGS. 10(*a*), 10(*b*) are plan views showing division of the area of the image data relative to the printing paper P in the second embodiment of the invention. In the structure of the second embodiment, the image data has a transition area between the center area and the peripheral area. The transition area is provided to prevent possible deterioration of the picture quality due to an abrupt change in ejection volume of the quality-enhancing ink between the peripheral area without ejection of the quality-enhancing ink and the center area with ejection of the quality-enhancing ink.

The transition area is set to increase the ejection volume of the quality-enhancing ink from the neighborhood of the peripheral area to the neighborhood of the center area, as clearly shown in FIG. 10(*b*). In the illustrated example of FIG. 10, the transition area is divided into three zones, and three different color conversion tables with different settings of the ejection volume of the quality-enhancing ink are applied to the respective zones. The number of divisions of the transition area is, however, not restricted to three but may be set arbitrarily.

In this example, a color conversion table having a relatively small tone value SM4 set to the maximum tone value of the quality-enhancing ink is applied to a zone of the transition area adjoining to the peripheral area. A color conversion table having a relatively large tone value SM2 set to the maximum tone value of the quality-enhancing ink is applied to a zone of the transition area adjoining to the center area. A color conversion table having the intermediate settings is adopted in the remaining middle zone of the transition area to assure a gentle variation in tone value of the quality-enhancing ink. This arrangement effectively prevents the appearance of a quasi-contour and deterioration of the picture quality due to an abrupt change in ejection volume of the quality-enhancing ink.

The procedure of the second embodiment sets the transition area between the peripheral area and the center area to increase the ejection volume of the quality-enhancing ink from the neighborhood of the peripheral area to the neighborhood of the center area. This arrangement advantageously reduce potential deterioration of the picture quality due to an abrupt change in ejection volume of the quality-enhancing ink between the peripheral area and the center area.

In the structure of the second embodiment, the transition area is set as part of the center area of the first embodiment. The transition area may, however, be set to cross the boundary between the center area and the peripheral area of the first embodiment. The transition area may otherwise be set as part of the peripheral area of the first embodiment.

D. Print Data Generation Process of Third Embodiment

Figure 11A:
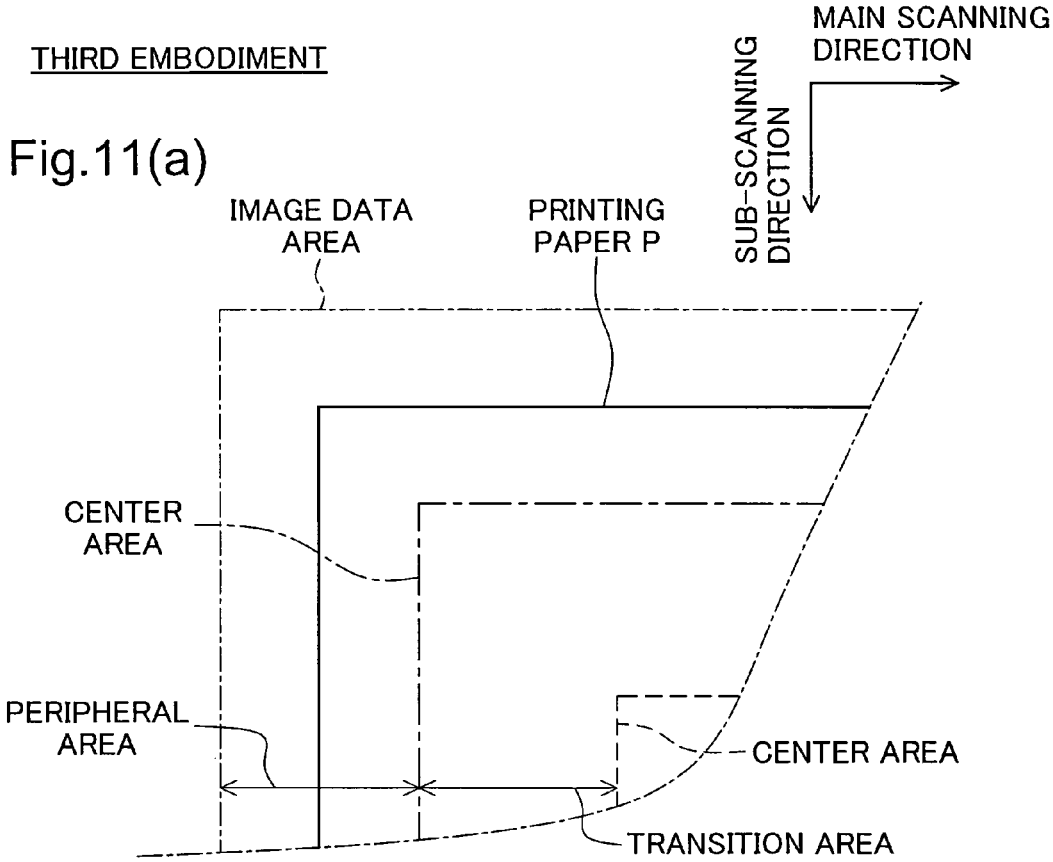
FIGS. 11(*a*), 11(*b*) are plan views showing division of the area of image data relative to the printing paper P in the third embodiment of the invention.
Figure 11B:
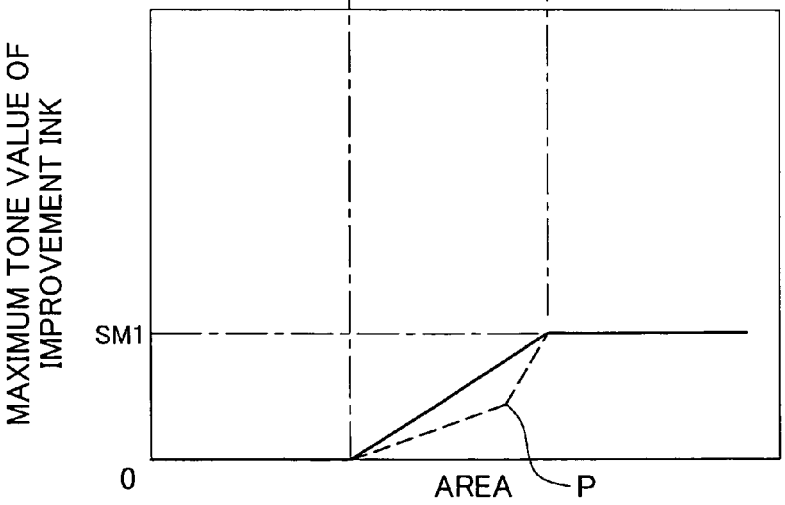

FIGS. 11(*a*), 11(*b*) are plan views showing division of the area of the image data relative to the printing paper P in the third embodiment of the invention. The structure of the third embodiment has a transition area, like the structure of the second embodiment. The difference from the second embodiment is a method of determining the tone value of the quality-enhancing ink in the transition area.

The procedure of the second embodiment applies the color conversion tables having the intermediate settings between the color conversion table for the peripheral area and the color conversion table for the center area to the transition area. The procedure of the third embodiment, on the other hand, determines the ejection volume of the quality-enhancing ink by linear interpolation of the color conversion table for the peripheral area and the color conversion table for the center area as shown by a solid-line plot in FIG. 11(*b*). The linear interpolation determines the ejection volume of the quality-enhancing ink according to the distance between each object pixel to be processed and the peripheral area or the center area.

In this manner, the linear interpolation technique is applicable to determine the ejection volume of the quality-enhancing ink in the transition area, instead of application of the color conversion tables having the intermediate settings to the transition area.

The procedure of the third embodiment adopts the linear interpolation technique in the transition area between the center area and the peripheral area. Non-linear interpolation may alternatively be performed for determination of the ejection volume of the quality-enhancing ink. One concrete procedure of non-linear interpolation sets a color conversion table at a preset point P in the transition area as shown by the dotted line in FIG. 11(*b*) and utilizes this color conversion table for stepwise linear interpolation. Another concrete procedure of non-linear interpolation uses a non-linear equation.

The linear interpolation technique (including the stepwise linear interpolation technique), however, has the higher-speed advantage over the non-linear interpolation technique. The advantage of the non-linear interpolation technique is, on the other hand, a higher degree of freedom in interpolation.

E. Print Data Generation Process of Fourth Embodiment

FIGS. 12(*a*), 12(*b*) are plan views showing division of the area of the image data relative to the printing paper P in the fourth embodiment of the invention. The structure of the fourth embodiment has a transition area, like the structures of the second embodiment and the third embodiment. The difference from the second and the third embodiments is a method of determining the tone value of the quality-enhancing ink in the transition area.

The procedure of the fourth embodiment divides the transition area into two zones, that is, a first transition area and a second transition area, and applies different techniques of determining the ejection volume of the quality-enhancing ink to these two transition areas. The first transition area is an upper zone of the transition area in FIG. 12(*a*), and the second transition area is a remaining zone of the transition area.

The technique adopted in the first transition area is application of a color conversion table for the transition area like the second embodiment to determine the ejection volume of the quality-enhancing ink (see FIG. 12(*b*)). The technique adopted in the second transition area is interpolation like the third embodiment to determine the ejection volume of the quality-enhancing ink (not shown). Application of the different techniques to the respective divisions of the transition area to determine the ejection volume of the quality-enhancing ink effectively shortens the total time required for the color conversion.

The procedure of the fourth embodiment carries out color conversion with regard to each of the main scanning lines from the upper side in FIG. 12(*a*). Namely the procedure first makes a top-most main scanning line, which is a set of pixels aligned on an upper-most end in the main scanning direction, subjected to color conversion and then processes a next main scanning line immediately below the top-most main scanning line on completion of the processing of the top-most main scanning line. Each main scanning line is a set of consecutive pixels aligned in the main scanning direction.

One identical color conversion table is applicable to process the respective main scanning lines in the first transition area. The first transition area is accordingly processable at a higher speed by application of the color conversion table for the transition area like the second embodiment to determine the ejection volume of the quality-enhancing ink than the interpolation in the respective pixels like the third embodiment. Processing of the respective main scanning lines in the second transition area, however, requires multiple color conversion tables. The method of the second embodiment reads the multiple color conversion tables from a non-illustrated memory into a non-illustrated cache memory multiple times. Such reading takes time. The second transition area is thus processable at a higher speed by the interpolation technique like the third embodiment to determine the ejection volume of the quality-enhancing ink.

In the course of color conversion with regard to each of the main scanning lines, which is a set of consecutive pixels aligned in the main scanning direction, the interpolation technique is applied to determine the ejection volume of the quality-enhancing ink in the specific zone of the transition area where one main scanning line is unprocessable with one identical color conversion table. This procedure advantageously enhances the total processing speed. The technique of the fourth embodiment is applicable to a modified structure where the sub-scanning direction replaces the main scanning direction.

F. Modifications

The embodiments discussed above are to be considered in all aspects as illustrative and not restrictive. There may be many modifications, changes, and alterations without departing from the scope or spirit of the main characteristics of the present invention. Some examples of possible modification are given below.

F-1. Each of the embodiments discussed above adopts the systematic dither method for reduction of the number of tone values. Another color-quantizing technique like the error diffusion method or the density pattern method is applicable to reduce the number of tone values. One-to-one mapping of pixels in image data to pixels on a printing medium is not necessary. One pixel in the image data may be mapped to multiple pixels on the printing medium.

F-2. The embodiments discussed above regard the inkjet printers with piezoelectric elements. Each of the techniques of the respective embodiments is also applicable to bubble jet printers that eject ink droplets by means of bubbles produced in the ink through power supply to heaters attached to nozzles, diversity of other printers, and variety of other printing devices.

F-3. In the embodiments discussed above, the tone value of the quality-enhancing ink in the peripheral area is set equal to zero in the color conversion process that makes the color in each pixel of given image data expressed by the tone values of the colored inks and the quality-enhancing ink available in the color printer 20. One modified procedure may set the dot-recording rate of the quality-enhancing ink in the peripheral area equal to zero in the color-quantizing process for reducing the number of tone values.

Figure 13:
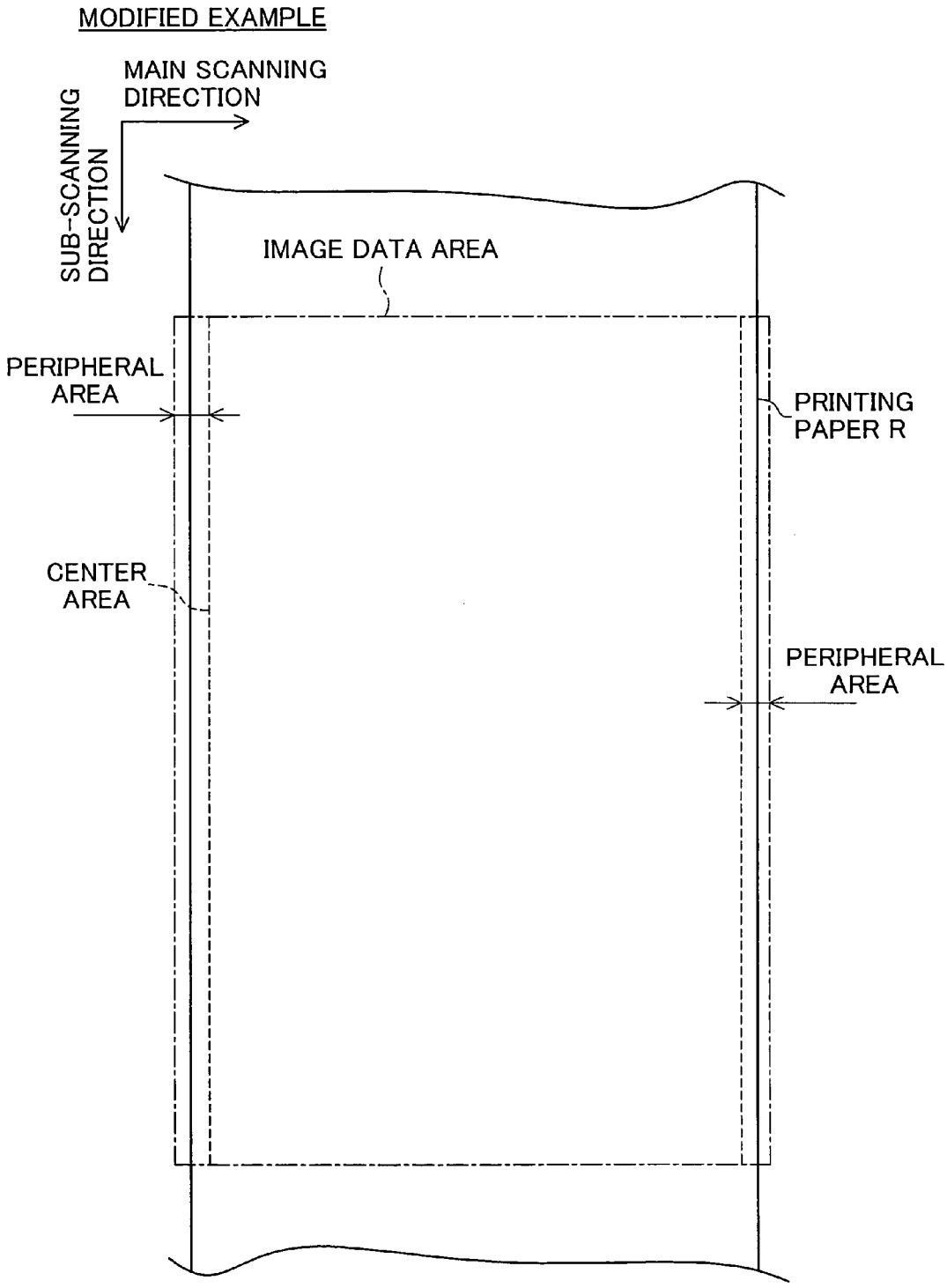
FIG. 13 is a plan view showing division of the area of image data relative to printing paper R in a modified example.

F-4. In the respective embodiments discussed above, the printing medium is the rectangular cut paper P. The technique of the invention is also applicable to printing on roll paper extending in the sub-scanning direction. In the case of printing on roll paper R, it is preferable to set the peripheral area and the transition area in the image data corresponding to only side ends of the printing medium parallel to the sub-scanning direction, as shown in FIG. 13. This arrangement desirably relieves the load of data processing of the image data corresponding to the remaining ends of the printing medium parallel to the main scanning direction, in the case of printing multiple images on the roll paper. This arrangement also advantageously prevents potential deterioration of the picture quality of a printed material, due to an abrupt decrease in ejection volume of the quality-enhancing ink.

F-5. In the embodiments discussed above, the print data is generated such that ejection of the quality-enhancing ink is prohibited in the peripheral area, in order to prevent the quality-enhancing ink from being flown outside the printing medium. One modified structure may set an operation mode, in which the control circuit 40 of the printer 20 restricts (stops or reduces) ejection of ink from nozzles for the quality-enhancing ink, in the case where the nozzles for the quality-enhancing ink are located in the peripheral area. One applicable method to the restriction (stop or reduction) rewrites the contents of the raster data. Another applicable method opens a circuit to driving elements of the ink.

F-6. The technique of the invention is not restricted to color printing but is also applicable to monochromatic printing. The technique is also applicable to a printing system that is capable of creating multiple dots in one pixel to express multiple tones.

F-7. In the embodiments discussed above, the dot-recording rate of the quality-enhancing ink is set equal to zero with regard to the pixels belonging to the peripheral area. Setting the dot-recording rate to zero is, however, not essential. The only requirement is that the dot-recording rate of the quality-enhancing ink in the pixels of the peripheral area is set lower than the dot-recording rate of the quality-enhancing ink in the pixels of the center area. For example, the dot-recording rate of the quality-enhancing ink in the center area may be set equal to approximately 10%, while the dot-recording rate of the quality-enhancing ink in the peripheral area may be set to be not greater than 1%.

F-8. In the embodiments discussed above, the dot-recording rate of the quality-enhancing ink is uniformly set equal to zero with regard to the pixels belonging to the peripheral area. If the quality-enhancing ink is absorbable by the ink absorption material like the colored links, however, complete reduction of the dot-recording rate of the quality-enhancing ink is not required with regard to the pixels included in the peripheral area. The dot data generation module of the invention is generally designed to have a processing mode that makes the ink dot-recording rate of the quality-enhancing ink in the pixels of the peripheral area lower than the ink dot-recording rate of the quality-enhancing ink in the pixels of the center area.

F-9. In the respective embodiments discussed above, part of the hardware configuration may be replaced by the software, while part of the software configuration may be replaced by the hardware. For example, part or all of the functions of the printer driver 96 shown in FIG. 1 may be executed by the control circuit 40 included in the printer 20. In this modified structure, part or all of the functions of the computer 90 as the printing control apparatus of generating print data is attained by the control circuit 40 of the printer 20.

Part or all of the functions of the invention may be actualized by the software. In such cases, the software (computer programs) may be supplied in the form recorded in a computer readable recording medium. In the terminology of this invention, the 'computer readable recording medium' is not restricted to portable recording media like flexible disks and CD-ROMs but includes internal storage devices of the computer like various RAMs and ROMs and external storage devices fixed to the computer like hard disks.

All changes within the meaning and range of equivalency of the claims are intended to be embraced therein. The scope and spirit of the present invention are indicated by the appended claims, rather than by the foregoing description.

Finally, the present application claims the priority based on Japanese Patent Application No. 2003-193262 filed on Jul. 8, 2003, which is herein incorporated by reference.

What is claimed is:

1. A printing control method of generating print data to be supplied to a print unit to print, the print unit forming dots on a print medium by ejecting ink droplets of at least one type of colored ink containing a color material and a quality-enhancing ink for enhancing quality of a printed material, the printing control method comprising:

a dot data-generating step of generating dot data representing a state of dot formation at each pixel in a printed image to reproduce an image represented by a given image data, by formation of dots in respective pixels with the at least one colored ink and the quality-enhancing ink available in the print unit, wherein the dot data-generating step includes a processing mode configured to make a quality-enhancing ink dot-recording rate for pixels belonging to a peripheral area lower than the quality-enhancing ink dot-recording rate for pixels belonging to a center area with regard to at least one identical pixel value of the image data, wherein the quality-enhancing ink dot-recording rate is a dot-recording rate of the quality-enhancing ink;

the peripheral area is set at end portions of the printing medium;

the center area is set in a central portion of the printing medium; and wherein the dot data-generating step further includes a color conversion step of converting color in each pixel of the image data into a tone value, the tone value being for expressing the color with the at least one colored ink and the quality-enhancing ink available in the print unit, and a color-quantizing step of generating the dot data representing a state of dot formation at each pixel, in response to the converted tone value with regard to each pixel of the image data, wherein the color conversion step includes a processing mode configured to make a quality-enhancing ink tone value for pixels belonging to the peripheral area lower than the quality-enhancing ink tone value for pixels belonging to the center area with regard to at least one identical pixel value of the image data, and wherein the quality-enhancing ink tone value is the tone value of the quality-enhancing ink.

2. The printing control method in accordance with claim 1, wherein the color conversion step comprises the steps of:

a table-reading step of reading a peripheral area color conversion table and a center area color conversion table, the peripheral area color conversion table being a color conversion table applied for the pixels belonging to the peripheral area, the center area color conversion table being a color conversion table applied for the pixels belonging to the center area; and a table selection step of selecting the peripheral area color conversion table for the pixels belonging to the peripheral area, while selecting the center area color conversion table for the pixels belonging to the center area.

3. The printing control method in accordance with claim 2, wherein a transition area is further set between the peripheral area and the center area, wherein the color-quantizing step comprises the step of interpolating with the peripheral area color conversion table and the center area color conversion table to determine the quality-enhancing ink tone value in the transition area.

4. The printing control method in accordance with claim 2, wherein a transition area is further set between the peripheral area and the center area, wherein the table-reading step comprises the step of further reading a transition area color conversion table, the transition area color conversion table being a color conversion table applied for the pixels belonging to the transition area, the table selection step includes the step of selecting the transition area color conversion table for the pixels belonging to the transition area, the transition area color conversion table is configured such that the quality-enhancing ink tone value for the transition area is higher than the peripheral area color conversion table but lower than the center area color conversion table with regard to at least one identical pixel value prior to the color conversion.

5. The printing control method in accordance with claim 4, wherein the table-reading step includes the step of reading multiple color conversion tables for the transition area, the multiple color conversion tables having different quality-enhancing ink tone values with regard to at least one identical pixel value prior to the color conversion, and the table selection step includes the step of selecting a color conversion table for transition area having higher quality-enhancing ink tone values to be applied to pixels in closer position to the center area within the transition area, wherein the multiple color conversion tables have quality-enhancing ink tone values higher than the peripheral area color conversion table but lower than the center area color conversion table with regard to at least one identical pixel value prior to the color conversion.

6. The printing control method in accordance with claim 3, wherein the color conversion step includes the step of converting by each main scanning line that is consecutive pixels aligned in a main scanning direction, and the interpolating step of interpolating with the peripheral area color conversion tale and the center area color conversion table to determine the quality-enhancing ink tone values in the transition area, if the color conversion process for one main scanning line needs more than one color conversion table for the color conversion.

7. The printing control method in accordance with claim 3, wherein the color conversion step includes the step of converting by each sub-scanning line that is consecutive pixels aligned in a sub-scanning direction, and the interpolating step of interpolating with the peripheral area color conversion tale and the center area color conversion table to determine the quality-enhancing ink tone values in the transition area, if the color conversion process for one sub-scanning line needs more than one color conversion table for the color conversion.

8. A printing method of forming dots on a printing medium to print an image, the printing method comprising the steps of:

(a) providing a print unit configured to form the dots on a print medium by ejecting ink droplets of at least one type of colored ink containing a color material and a quality-enhancing ink for enhancing quality of a printed material; and (b) generating dot data representing a state of dot formation at each pixel in a printed image to reproduce an image represented by a given image data, by formation of dots in respective pixels with the at least one colored ink and the quality-enhancing ink available in the print unit, wherein the step (b) includes a processing mode configured to make a quality-enhancing ink dot-recording rate for pixels belonging to a peripheral area lower than the quality-enhancing ink dot-recording rate for pixels belonging to a center area with regard to at least one identical pixel value of the image data, wherein the quality-enhancing ink dot-recording rate is a dot-recording rate of the quality-enhancing ink;

the peripheral area is set at end portions of the printing medium;

the center area is set in a central portion of the printing medium; and wherein the step (b) further includes a color conversion step of converting color in each pixel of the image data into a tone value, the tone value being for expressing the color with the at least one colored ink and the quality-enhancing ink available in the print unit, and a color-quantizing step of generating the dot data representing a state of dot formation at each pixel, in response to the converted tone value with regard to each pixel of the image data, wherein the color conversion step includes a processing mode configured to make a quality-enhancing ink tone value for pixels belonging to the peripheral area lower than the quality-enhancing ink tone value for pixels belonging to the center area with regard to at least one identical pixel value of the image data, and wherein the quality-enhancing ink tone value is the tone value of the quality-enhancing ink.

9. A printing apparatus for forming dots on a printing medium to print an image, the printing apparatus comprising:

a print unit configured to form the dots on a print medium by ejecting ink droplets of at least one type of colored ink containing a color material and a quality-enhancing ink for enhancing quality of a printed material; and a dot data generator configured to generate dot data representing a state of dot formation at each pixel in a printed image to reproduce an image represented by a given image data, by formation of dots in respective pixels with the at least one colored ink and the quality-enhancing ink available in the print unit, wherein the dot data generator includes a processing mode configured to make a quality-enhancing ink dot-recording rate for pixels belonging to a peripheral area lower than the quality-enhancing ink dot-recording rate for pixels belonging to a center area with regard to at least one identical pixel value of the image data, wherein the quality-enhancing ink dot-recording rate is a dot-recording rate of the quality-enhancing ink;

the peripheral area is set at end portions of the printing medium;

the center area is set in a central portion of the printing medium; and wherein the dot data generator further includes a color converter configured to convert color in each pixel of the image data into a tone value, the tone value being for expressing the color with the at least one colored ink and the quality-enhancing ink available in the print unit, and a color quantizer configured to generate the dot data representing a state of dot formation at each pixel, in response to the converted tone value with regard to each pixel of the image data, wherein the color converter includes a processing mode configured to make a quality-enhancing ink tone value for pixels belonging to the peripheral area lower than the quality-enhancing ink tone value for pixels belonging to the center area with regard to at least one identical pixel value of the image data, and wherein the quality-enhancing ink tone value is the tone value of the quality-enhancing ink.

10. A printing control apparatus for generating print data to be supplied to a print unit to print, the print unit forming dots on a print medium by ejecting ink droplets of at least one type of colored ink containing a color material and a quality-enhancing ink for enhancing quality of a printed material, the printing control apparatus comprising:

a dot data generator configured to generate dot data representing a state of dot formation at each pixel in a printed image to reproduce an image represented by a given image data, by formation of dots in respective pixels with the at least one colored ink and the quality-enhancing ink available in the print unit, wherein the dot data generator has a processing mode configured to make a quality-enhancing ink dot-recording rate for pixels belonging to a peripheral area lower than the quality-enhancing ink dot-recording rate for pixels belonging to a center area with regard to at least one identical pixel value of the image data, wherein the quality-enhancing ink dot-recording rate is a dot-recording rate of the quality-enhancing ink;

the peripheral area is set at end portions of the printing medium;

the center area is set in a central portion of the printing medium; and wherein the dot data generator further includes a color converter configured to convert color in each pixel of the image data into a tone value, the tone value being for expressing the color with the at least one colored ink and the quality-enhancing ink available in the print unit, and a color quantizer configured to generate the dot data representing a state of dot formation at each pixel, in response to the converted tone value with regard to each pixel of the image data, wherein the color converter includes a processing mode configured to make a quality-enhancing ink tone value for pixels belonging to the peripheral area lower than the quality-enhancing ink tone value for pixels belonging to the center area with regard to at least one identical pixel value of the image data, and wherein the quality-enhancing ink tone value is the tone value of the quality-enhancing ink.

11. A computer program product for causing a computer to generate print data to be supplied to a print unit to print, the print unit forming dots on a print medium by ejecting ink droplets of at least one type of colored ink containing a color material and a quality-enhancing ink for enhancing quality of a printed material, the computer program product comprising:

a computer-readable storage medium; and a computer program including computer-executable instructions stored on the computer-readable storage medium, the computer program comprising:

a first program for causing the computer to generate dot data representing a state of dot formation at each pixel in a printed image to reproduce an image represented by a given image data, by formation of dots in respective pixels with the at least one colored ink and the quality-enhancing ink available in the print unit, wherein the first program includes a processing mode configured to make a quality-enhancing ink dot-recording rate for pixels belonging to a peripheral area lower than the quality-enhancing ink dot-recording rate for pixels belonging to a center area with regard to at least one identical pixel value of the image data, wherein the quality-enhancing ink dot-recording rate is a dot-recording rate of the quality-enhancing ink;

the peripheral area is set at end portions of the printing medium;

the center area is set in a central portion of the printing medium; and wherein the computer program further includes a second program for causing the computer to convert color in each pixel of the image data into a tone value, the tone value being for expressing the color with the at least one colored ink and the quality-enhancing ink available in the print unit, and a third program for causing the computer to generate the dot data representing a state of dot formation at each pixel, in response to the converted tone value with regard to each pixel of the image data, wherein the second program includes a processing mode configured to make a quality-enhancing ink tone value for pixels belonging to the peripheral area lower than the quality-enhancing ink tone value for pixels belonging to the center area with regard to at least one identical pixel value of the image data, and wherein the quality-enhancing ink tone value is the tone value of the quality-enhancing ink.

* * * * *